United States Patent [19]

Goodheim

[11] 4,036,170

[45] July 19, 1977

[54] MEANS FOR APPLYING ZINC STEARATE COATINGS TO THE BORE SURFACES OF FERROUS ALLOY TUBES

[75] Inventor: Harold Goodheim, Elnora, N.Y.

[73] Assignee: The United States Government, Washington, D.C.

[21] Appl. No.: 621,325

[22] Filed: Oct. 10, 1975

[51] Int. Cl.[2] ..... B05C 7/04

[52] U.S. Cl. ..... 118/73; 118/408

[58] Field of Search ..... 118/408, 73, 421, 429; 134/102, 103, 99, 169 R, 169 C, 171; 137/240

[56] References Cited

U.S. PATENT DOCUMENTS

| | | | |
|---|---|---|---|
| 1,194,542 | 8/1916 | Raymond | 134/169 C X |
| 2,483,709 | 10/1949 | Paulsen | 134/105 X |
| 3,458,133 | 7/1969 | Wiggins | 137/240 X |
| 3,667,487 | 6/1972 | Schoenbeck et al. | 134/169 R X |

*Primary Examiner*—John P. McIntosh

*Attorney, Agent, or Firm*—Nathan Edelberg; Robert P. Gibson

[57] ABSTRACT

In order to form an adherent coating of zinc stearate on the bore surfaces of a plurality of tubes grouped in parallel relation, an alkali cleaner solution is circulated therethrough from a reservoir tank and then returned to the tank by a flow of purge air which is thereafter vented to the atmosphere to remove any alkali residue from the system. A phosphate solution, an alkali neutralizer solution, and a stearate solution are, in turn, similarly circulated and returned to their respective reservoir tanks. Each circulation is followed by a corresponding circulation of hot rinse water which is also returned to its reservoir tank by the same air purge technique.

3 Claims, 5 Drawing Figures

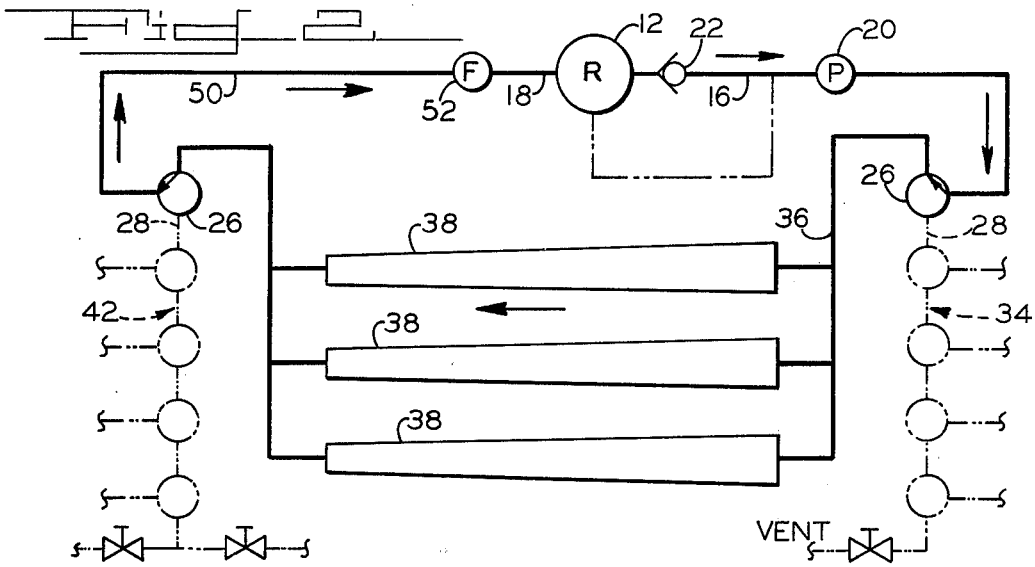
12
22
20
F
R
P
50
52
18
16
26
28
26
38
36
28
42
38
34
38
VENT
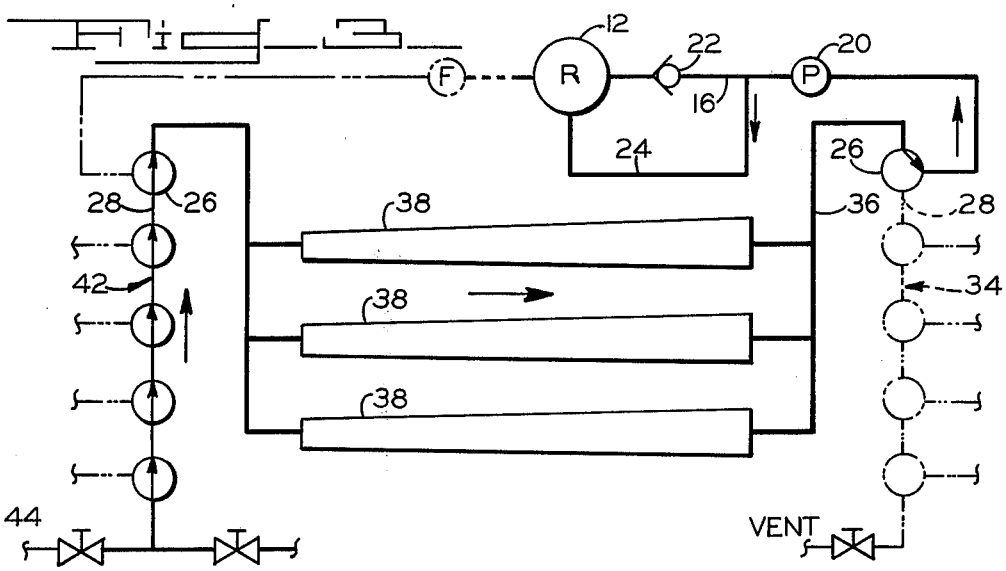
12
22
20
F
R
P
16
24
26
28
26
38
36
28
42
38
34
38
44
VENT
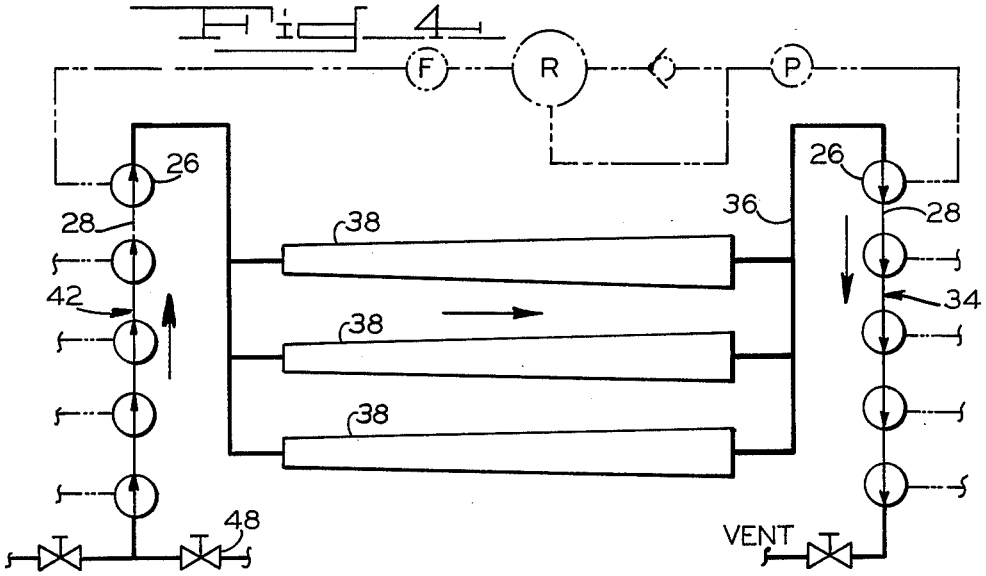
F
R
P
26
26
28
38
36
28
42
38
34
38
48
VENT

MEANS FOR APPLYING ZINC STEARATE COATINGS TO THE BORE SURFACES OF FERROUS ALLOY TUBES

The invention described herein may be manufactured, used, and licensed by or for the Government for Governmental purposes without the payment to me of any royalties thereon.

BACKGROUND OF THE INVENTION

This invention relates to the formation of lubricant coatings on metal surfaces and is more particularly directed to an improved means for coating the interior surfaces of steel tubes with an adherent layer of zinc stearate.

It is well known that the endurance life of gun tubes can be appreciably increased by forcing a metal slug or a "swage" tool through the bore of the tube to induce residual stresses in the walls thereof which serve to partially counteract the stresses encountered during actual firing. In order to prevent seizing or galling by the swage tool, the bore surface of the gun tube is customarily coated with a layer of electrolytically deposited lead. While the physical characteristics of these coatings are generally satisfactory, the electroplating thereof on a production basis is extremely costly due to the need for frequent replacement of the plating anodes. In addition, the toxicity of the metal mandates the provision of special equipment and procedures for removing the health hazard to which the operating personnel are exposed. The total cost involved is even further increased by the considerable effort and time required to remove the lead coating from the gun tube prior to the firing thereof. These drawbacks have therefore prompted a search for other materials capable of providing the required degree of lubricity without any sacrifice in the adherence of the coating under the relatively high pressures generated by the forced passage of the swage tool through the bore of the gun tube.

A zinc stearate coating appeared to be an acceptable substitute for the lead in view of the excellent results achieved therewith in the drawing of thin-walled tubing. A particularly desirable characteristic of this material was the complete vaporization thereof at the temperatures produced during the swaging process. However, the application of the coating to the bore surfaces by the conventional procedure of dipping the tubes into the required treatment fluids was found to be impractical due to the cumbersome and expensive handling equipment required to transfer the relatively long and heavy tubes from one treatment fluid to the other. Another problem lay in the relatively complex cleaning and rinsing procedures required to prevent any intermingling and resulting contamination between the separate treatment fluids.

SUMMARY OF THE INVENTION

Accordingly, it is a prime object of this invention to provide an automated procedure for successively flowing each of a plurality of treatment fluids through one or more tubes to form an adherent coating on the bore surfaces thereof.

It is another object of this invention to provide a flow procedure, as aforesaid, wherein each treatment fluid is individually isolated and controlled to prevent any contamination or intermingling therebetween.

A further object of the present invention resides in the provision of a system for simultaneously coating the bore surfaces of a plurality of gun tubes with a layer of zinc stearate wherein the valves utilized to select each treatment fluid for passage through the tubes are individually interconnected to eliminate the need for separate manifolds.

Still another object of this invention is to provide a system, as aforesaid, wherein each passage of a treatment fluid through the gun tubes is followed by a purging flow of air and a subsequent water rinse for cleansing the flow lines for the passage of the next treatment fluid therethrough.

It has been found that the aforesaid objects can best be accomplished by a system containing each of the treatment fluids and a separate supply of rinse water in individual storage tanks respectively connected to a series of solenoid-activated three-way valves. These valves are, in turn, disposed in axial alignment and interconnected to serve as a manifold for selectively diverting each treatment fluid and rinse water into the breech ends of a plurality of large caliber guns fixedly mounted in a parallel grouping. A second identical manifold is similarly connected to the muzzle ends of the gun tubes for establishing a corresponding series of flow lines leading back to the storage tanks. When the corresponding valves in both manifolds are simultaneously activated, the selected treatment fluid is continuously circulated through the gun tubes and the storage tanks for a predetermined period of time. Each flow of treatment fluid and rinse water is followed by a purging flow of air introduced into the end of one manifold to force the fluid remaining in the flow lines back to the respective storage tank therefor. The air pressure introduced into the flow lines during each purging thereof is relieved by the venting thereof from the end of the other manifold.

BRIEF DESCRIPTION OF THE DRAWINGS

The exact nature of the invention as well as other objects and advantages thereof will be readily apparent from consideration of the following specification relating to the annexed drawings, wherein:

FIG. 2 is a schematic representation showing the flow path followed by one of the treatment fluids;

FIG. 3 is a similar schematic view showing the flow path of the pressurized air during the purging cycle thereof;

FIG. 4 is a similar schematic view showing the air flow path during the venting cycle thereof.

DESCRIPTION OF A PREFERRED EMBODIMENT

Figure 1:
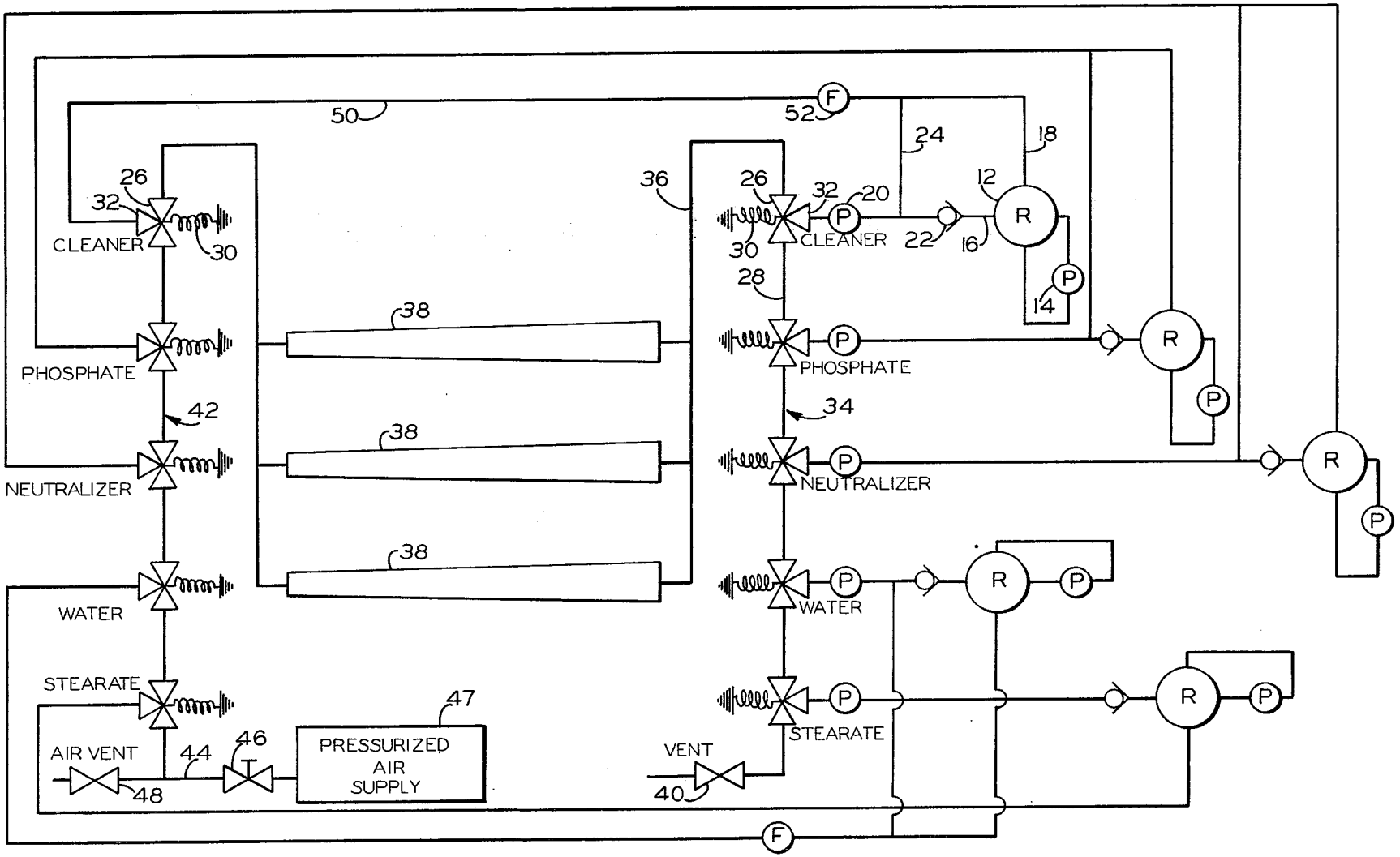
FIG. 1 is a schematic illustration of the entire system of the present invention.

While zinc stearate coatings may be applied to ferrous alloy surfaces by several techniques, it has been found that the required degree of surface adherence to the type of high-strength steel alloy generally utilized in the fabrication of large caliber gun tubes is best attained by first cleaning the ferrous surfaces with an alkali solution preferably formed by dissolving a mixture of 50% caustic soda (NaOH) and 40% metasilicate in a 1:10 aqueous solution to provide a 13 pH. The cleaned surface is thereafter subjected to a 10% by volume aqueous phosphate solution which reacts with the ferrous surfaces to form a relatively porous adherent layer of mixed zinc and iron phosphates. This phosphate layer is then neutralized with a alkali solution formed by dissolving one pound of powdered caustic soda in 100 gallons of water. The next treatment solution consists of 85 pounds of a powdered soap, such as the Granodraw No. 15 supplied by Amchem Products, Inc. of Ambler, Pa., dissolved in 100 gallons of water. As the stearate portion of the soap solution contacts the porous phosphate layer and enters into the interstices thereof, the resulting ion interchange produces a zinc stearate which dries to a thin hard coating. Since the shear strength of the stearate is much lower than that of the ferrous base of the gun tube, the coating provides an extremely effective degree of lubrication during the pressure contact thereagainst by the swage tool. Each of these treatment solutions is maintained at a temperature between 180°-190° F with the stearate preferably held at the higher end of the temperature range. A hot water rinse at a temperature of about 170° F follows each application of a treatment solution.

The foregoing solutions and the rinse water are contained in individual storage tanks or reservoirs 12 provided with heaters (not shown) which are thermostatically controlled to operate for given periods at predetermined temperatures. A circulation pump 14 is connected to each reservoir 12 for maintaining the contents thereof at the same temperature throughout. Each reservoir 12 is also provided with an exit line 16 at the lower end thereof and an entrance line 18 at the upper end thereof. Each exit line 16 leads to a hydraulic drive pump 20 and includes a check valve 22 for blocking the return of the treatment fluid to reservoir 12 during those periods in which pump 20 is not operating. A bypass line 24 is provided between entrance and exit lines 16 and 18 at a location intermediate pump 20 and check valve 22 and serves to divert the flow of purge air, to be hereinafter described, to the upper end of reservoir 12 and thereby prevent the undesirable agitation and foaming of the contents thereof which would otherwise occur if such purge air were forced upwardly therethrough. Each pump 20 is, in turn, connected to one of a series of ball valves 26 joined in axial alignment by interconnecting lines 28 and arranged to be activated by a solenoid 30. Valves 26 are each formed with a three-way configuration for providing a through passage between lines 28 and an entrance port 32 disposed at right angles to the through passage for admitting the flow of fluid from drive pump 20 when the latter is actuated by solenoid 30. Thus, valves 26 form a manifold 34 for the flow therethrough of only the fluid from the particular drive pump 20 selected for activation. One end of manifold 34 is connected to a flow line 36 which includes a plurality of identical branches leading to the respective bores of a plurality of fixedly-mounted gun tubes 38 while the opposite end of manifold 34 is provided with a two-way vent valve 40.

Although not so shown in the drawings, gun tubes 38 are preferably inclined so that the muzzle ends thereof are at a slightly higher elevation than the breech ends thereof. A second manifold 42 essentially duplicative of manifold 34 is similarly connected at one end thereof to the muzzle ends of gun tubes 38. The opposite end of manifold 42 is connected to an air line 44 leading in one direction to a two-way air valve 46 controlling a flow of air from a supply source 47 at a pressure of about 20 psi (70.3 gram per sq/cm) and leading in the opposite direction to a normally-closed safety vent 48. Each of the ball valves 26 in manifold 42 is connected to a flow line 50 leading back to the upper end of the corresponding reservoir 12. Suitable filters 52 are included in the particular lines 50 which lead to the reservoirs 12 containing the alkali cleaner and rinse water solutions.

Figure 5:
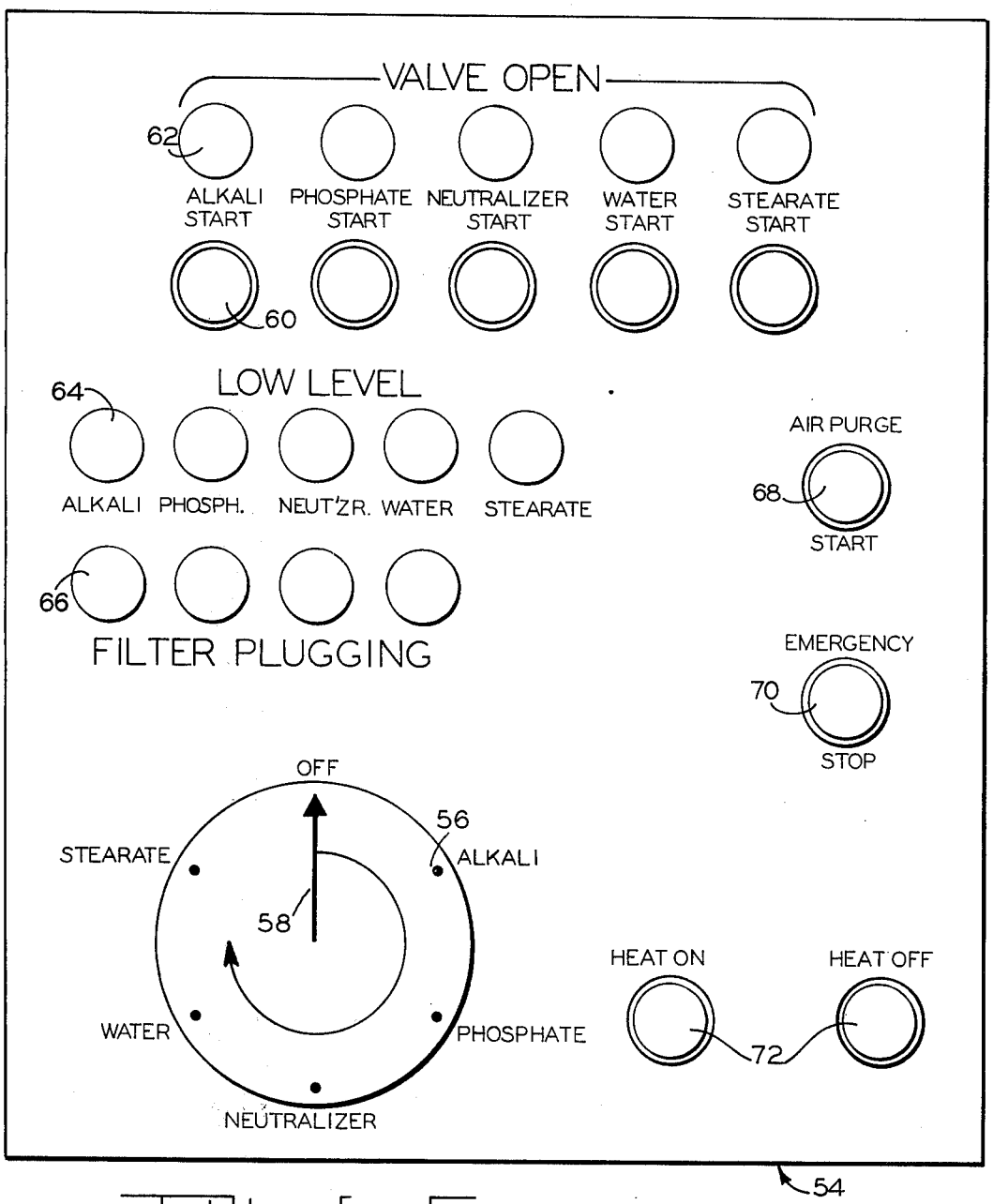
FIG. 5 is a schematic arrangement of the control panel from which the system is operated.

The system also includes a control panel 54 which, as best shown in FIG. 5, includes a plurality of switches 56 equally spaced about the periphery of a circle in respective electrical connection with solenoids 30 in manifolds 34 and 42. An indicator lever 58 is rotatably secured at one end thereof in the center of the set of switches 56 to provide for the selective contact therewith or an "off" setting in the 12 o'clock position thereof. A series of push buttons 60 are also provided on panel 54 for energizing the selected solenoid 30 to open entrance port 32 in the corresponding ball valves 26 in manifolds 34 and 42 and simultaneously initiating operation of drive pump 20 connected thereto. Information concerning the identity of the particular drive pump 20 in operation at any given time is provided by a set of corresponding indicator lights 62 at the upper portion of control panel 54. Similar lights are also provided, as shown at 64 and 66, to respectively serve as a warning to the operator that reservoirs 12 require replenishment of the contents thereof and as a warning that one or more of filters 52 in the flow lines leading to reservoirs 12 are plugged. A single push button 68 is also provided to initiate the air purging step required after each flow of treatment fluid. A similar button 70 serves to shut down the entire system in the event of an emergency. In addition, a pair of push buttons 72 are provided to start and stop the heating of reservoirs 12 and the flow lines associated therewith.

Once the contents of reservoirs 12 have been heated to the desired temperature and stirred to provide the desired uniformity thereof, the coating process is initiated by rotating selector lever 58 to the alkali contact 56 and activating the proper push button 60 to pump alkali cleaner through gun tubes 38 in accordance with the setting of an internal timer (not shown). The termination of this pumping action automatically closes the entrance port 32 in the associated ball valve 26 in manifold 42 but leaves open the port in the corresponding ball valve 26 in manifold 34. Thus, when air valve 46 is activated by button 68 to send purge air into manifold 42, for a predetermined interval of time, the alkali cleaner fluid in the flow lines and in gun tubes 38 is forced back through the associated ball valve 26 in manifold 34 and into by-pass line 24 to return to the upper end of reservoir 12. Vent valve 40 is then opened to relieve the pressure of the purge air which carries with it any alkali cleaner residue remaining in the system. Thereafter, valve 40 is closed and indicator lever 58 rotated to contact switch 56 for closing the electrical circuit to the reservoir 12 containing the heated water. The change in position of lever 58 also serves to close the entrance port 32 in the ball valve 26 in manifold 34 which had been left open at the end of the pumping of the alkali cleaner. The system is now ready for the flow of rinse water from the reservoir 12 therefor which is followed by an air purge in the same manner as that described in connection with the flow of the alkali cleaner solution. The rest of the treatment fluids are disposed, in turn, in exactly the same manner. The thin hard zinc stearate coating produced by the foregoing treatment will adequately resist the pressures produced by the subsequent passage of a swage tool through the bores of gun tubes 38 and also provide the lubrication necessary to facilitate such passage.

The foregoing disclosure and description of the invention is illustrative only. Various changes may be made within the scope of the appended claims without departing from the spirit of the invention.

I claim:

1. In a system for successively flowing each of a plurality of individually stored treatment fluids through a series of parallel tubes, with a minimum of contamination between successive fluids, the combination of, a plurality of multiport valves connected to form a manifold adjacent each of the opposite ends of the tubes in respective communication with each of the treatment fluids, switch means for activating corresponding valves in each of said manifolds to establish a flow path between the tubes and one of the treatment fluids, pump means interposed between each of the stored treatment fluids and said manifold nearest thereto for circulating the selected fluid through the tubes in response to the actuation of said switch means, valve means in one of said manifolds for introducing pressurized air into said established flow path to force said selected treatment fluid back to the initial storage position thereof, and vent means in the other of said manifolds for exhausting said pressurized air from said flow path to thereby purge any residue of said selected treatment fluid therein prior to the circulation of the next selected treatment fluid through the tubes.

2. A system for coating the interior surface of a plurality of ferrous alloy tubes with an adherent layer of zinc stearate, comprising, a plurality of storage reservoirs for each of the fluids involved in treating the ferrous interiors of the tubes to produce the zinc stearate coating thereon, a plurality of three-way valves connected in a double row to form a first and a second manifold in direct communication with each of said storage reservoirs, switch means for selectively energizing corresponding valves in said manifolds to establish a flow path between one of said storage reservoirs and the tubes, pump means interposed between each of said storage reservoirs and said three-way valves in said first manifold and responsive to said switch means for circulating one of said treatment fluids through the tubes to said second manifold and back to said storage reservoir, a two-way valve connected to one end of said second manifold for introducing pressurized air into said established flow path to force said treatment fluid therein back to said storage reservoir therefor, and a vent valve connected to one end of said first manifold for exhausting said pressurized air from said established flow path to purge any residual treatment fluid from the tubes and said manifolds prior to actuation of said switch means for selecting said next treatment fluid to be circulated through the tubes.

3. The system defined in claim 2 wherein the termination of operation of said pump means in said established flow path through said first manifold automatically closes said corresponding three-way valve in said second manifold to thereby provide a flow path for said pressurized air to return said circulating treatment fluid back to said storage reservoir therefor.

* * * * *